US008075076B2

(12) United States Patent
Ootsuka

(10) Patent No.: US 8,075,076 B2
(45) Date of Patent: Dec. 13, 2011

(54) SIGNAL PROCESSING APPARATUS, DROPLET EJECTION APPARATUS AND SIGNAL PROCESSING METHOD

(75) Inventor: Hiroyuki Ootsuka, Kanagawa (JP)

(73) Assignee: Fujifilm Coporation, Tokyo (JP)

( * ) Notice: Subject to any disclaimer, the term of this patent is extended or adjusted under 35 U.S.C. 154(b) by 488 days.

(21) Appl. No.: 12/382,921

(22) Filed: Mar. 26, 2009

(65) Prior Publication Data

US 2009/0244133 A1 Oct. 1, 2009

(30) Foreign Application Priority Data

Mar. 28, 2008 (JP) ..... 2008-086939

(51) Int. Cl.
*B41J 29/39* (2006.01)

(52) U.S. Cl. ..... 347/9; 347/12; 347/19; 347/50

(58) Field of Classification Search ..... None
See application file for complete search history.

(56) References Cited

U.S. PATENT DOCUMENTS 4,367,476 A * 1/1983 Sagae ..... 347/75

FOREIGN PATENT DOCUMENTS

JP 2000-094670 4/2000

* cited by examiner

*Primary Examiner* — Uyen Chau N Le
*Assistant Examiner* — Chad Smith
(74) *Attorney, Agent, or Firm* — Jean C. Edwards, Esq.; Edwards Neils PLLC

(57) ABSTRACT

A signal processing apparatus has a first circuit board having a digital/analog converter, a second circuit board having an operational amplifier, a connector connecting the first circuit board and the second circuit board, a transmitter on the first circuit board, and a controller on the second circuit board. The digital/analog converter converts, to an analog signal, a digital signal as a reference of a voltage to be applied to a capacitive load and outputs the analog signal. The operational amplifier is connected to the capacitive load at an output terminal thereof via a switching element, and amplifies the voltage of the analog signal to output. The transmitter transmits a predetermined signal to the second circuit board via the connector. The controller prevents the voltage of the analog signal from being applied to the capacitive load when the predetermined signal is not received in the second circuit board.

13 Claims, 12 Drawing Sheets

SIGNAL PROCESSING APPARATUS, DROPLET EJECTION APPARATUS AND SIGNAL PROCESSING METHOD

CROSS-REFERENCE TO RELATED APPLICATION

This application claims priority under 35 USC 119 from Japanese Patent Application No. 2008-086939, filed Mar. 28, 2008, the disclosure of which is incorporated by reference herein.

BACKGROUND OF THE INVENTION

1. Field of the Invention

The present invention relates to a signal processing apparatus, a droplet ejection apparatus, and a signal processing method.

2. Description of the Related Art

There has been known a droplet ejection apparatus in which by applying a voltage to a piezoelectric element to deform the piezoelectric element, a droplet is ejected (e.g., see Japanese Patent Application Laid-Open (JP-A) No. 2000-94670).

FIG. 12 is a circuit diagram showing a configuration example of a conventional drive circuit that applies a voltage to a piezoelectric element in a droplet ejection apparatus.

As shown in FIG. 12, this drive circuit 300 includes a digital/analog converter 302, an operational amplifier 304, and a current amplifier circuit 306. The digital/analog converter 302, an operational amplifier 304 and the current amplifier circuit 306 are connected in series. Moreover, piezoelectric elements 310 are each connected to the current amplifier circuit 306 via a switching element 308.

When a digital signal indicating a voltage as a reference of a voltage to be applied to each of the piezoelectric elements 310 is input to the digital/analog converter 320, the digital signal is converted to an analog signal in the digital/analog converter 302. The voltage of the analog signal is amplified by the operational amplifier 304 and the current thereof is current-amplified by the current amplifier circuit 306 to be output to each of the switching elements 308.

Each of the switching elements 308 switches between two states of a conduction state and a disconnection state according to a control signal (not shown), and when the switching element 308 is in the conduction state, the voltage of the analog signal output from the current amplifier circuit 306 is applied to the piezoelectric element 310.

The drive circuit as described above is generally configured on one circuit board, and thus even if some of components which configure the drive circuit have trouble, the whole drive circuit is exchanged. In this case, components which do not have any trouble are also consequently exchanged, which incurs waste in cost.

As a method for avoiding such a situation, a method in which the drive circuit is divided to make plural circuit boards and only the circuit board including the component having trouble is exchanged is considered. In this case, as a position where the drive circuit is divided, a position between the operational amplifier and the current amplifier circuit, and a position between the digital/analog converter and the operational amplifier are considered. In the former portion, a connection line for passing current to NPN and PNP transistors needs to be thicker and shorter, and a negative feedback loop also needs to be shorter for avoiding noise contamination than in the latter position. In view of these, the latter position is preferable.

In the case where the respective circuit boards obtained by dividing the circuit board on which the above-described drive circuit is configured between the digital/analog converter and the operational amplifier are connected via a connector, if a connection condition between the circuit boards is favorable, the voltage for drive is applied to the piezoelectric element via the switching element by putting a drain-source area of the switching element into a conduction state. In a conventional drive circuit, control is performed so as not to generate a potential difference in the drain and source area of the switching element.

SUMMARY OF THE INVENTION

The present invention has provided a signal processing apparatus, a droplet ejection apparatus, and a signal processing method.

According to an aspect of the invention, there is provided a signal processing apparatus including: a first circuit board including a digital/analog converter which converts, to an analog signal, a digital signal as a reference of a voltage to be applied to a capacitive load, and outputs the analog signal; a second circuit board including an operational amplifier connected to the capacitive load at an output terminal thereof via a switching element, that amplifies the voltage of the analog signal and outputs the analog signal; a connector that mechanically connects the first circuit board and the second circuit board such that the analog signal output from the digital/analog converter is input to an input terminal of the operational amplifier; a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

According to another aspect of the invention, there is provided a droplet ejection apparatus including: a droplet ejection head including nozzles, the nozzles each ejecting a droplet by a piezoelectric element being driven; a head controller that controls the droplet ejection head so as to eject the droplets from the nozzles on a recording medium based on image information; and a signal processing apparatus including: a first circuit board including a digital/analog converter which converts, to an analog signal, a digital signal as a reference of a voltage to be applied to a capacitive load and outputs the analog signal, the capacitive load being the piezoelectric element; a second circuit board including an operational amplifier connected to the capacitive load at an output terminal thereof via a switching element, that amplifies the voltage of the analog signal and outputs the analog signal; a connector that mechanically connects the first circuit board and the second circuit board such that the analog signal output from the digital/analog converter is input to an input terminal of the operational amplifier; a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

According to another aspect of the invention, there is provided a signal processing method including: transmitting a predetermined signal from a first circuit board including a digital/analog converter which converts, to an analog signal, a digital signal as a reference of a voltage to be applied to a capacitive load, and outputs the analog signal, to a second circuit board including an operational amplifier connected to the capacitive load at an output terminal thereof via a switching element, that amplifies the voltage of the analog signal and outputs the analog signal, via a connector which mechanically connects the first circuit board and the second circuit board such that the analog signal output from the digital/analog converter is input to an input terminal of the operational amplifier; and controlling to prevent the voltage of the analog signal from being applied to the capacitive load via the switching element when the predetermined signal is not received in the second circuit board.

BRIEF DESCRIPTION OF THE DRAWINGS

Preferred embodiments of the present invention will be described in detail based on the following figures, wherein.

DETAILED DESCRIPTION OF THE INVENTION

Figure 1:
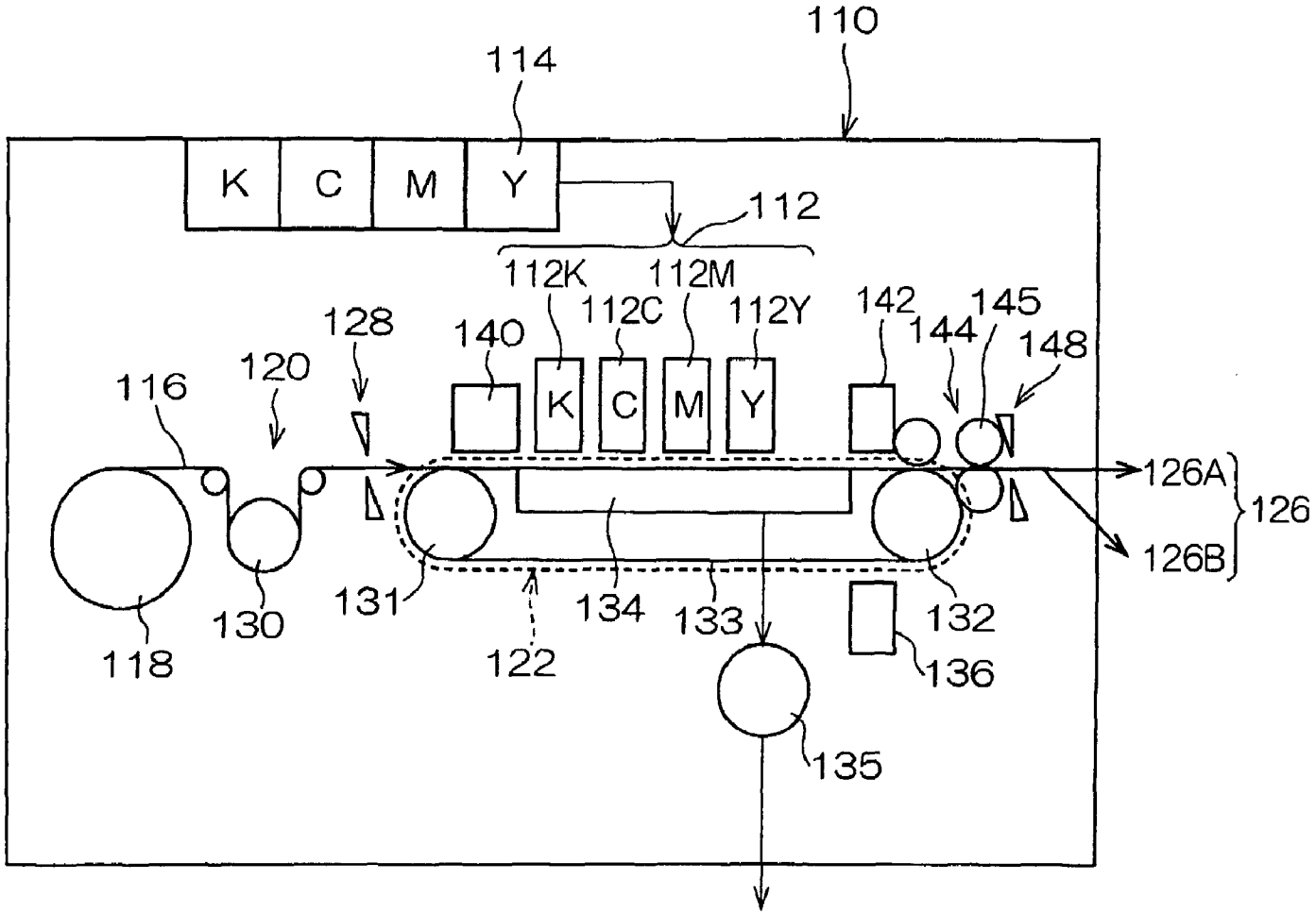
FIG. 1 is a side diagram showing an overall configuration of an ink-jet recording apparatus according to an exemplary embodiment.

In the above-described configuration, if poor connection of the connector is caused, there is a possibility that the application of the voltage for driving the piezoelectric element to the switching element causes an excessive potential difference in both terminals of the switching element before and after the connection by the connector, thereby damaging the switching element. This problem may also be caused in other capacitive loads.

The invention provides a signal processing apparatus, a droplet ejection apparatus, and a signal processing method capable of preventing damage of the switching element attributed to poor connection of the connector.

Hereinafter, referring to the drawings, preferred exemplary embodiments for carrying out the invention are described in detail. In the following exemplary embodiments, a case where a droplet ejection apparatus according to the invention is applied to an ink-jet recording apparatus is described.

First Exemplary Embodiment

FIG. 1 is a configuration diagram showing an overall configuration of an ink-jet recording apparatus according to a first exemplary embodiment.

As shown in FIG. 1, this inkjet recording apparatus 110 is disposed with: a printing unit 112 that includes plural recording heads (hereinafter called "heads") 112K, 112C, 112M and 112Y that are disposed in correspondence to inks of black (K), cyan (C), magenta (M) and yellow (Y); an ink storing unit 114 that stores the inks supplied to the heads 112K, 112C, 112M and 112Y; a paper supplying unit 118 that supplies recording paper 116 that is a recording medium; a decurling unit 120 that decurls the recording paper 116; a belt conveyance unit 122 that is disposed facing a nozzle surface (an ink ejection surface) of the printing unit 112 and conveys the recording paper 116 while preserving the planarity of the recording paper 116; and a paper discharging unit 126 that discharges the recorded recording paper 116 (print matter) to the outside. It will be noted that "printing" in the present specification includes the printing of characters and also the printing of images.

The ink storing unit 114 includes ink tanks that store inks of colors corresponding to the heads 112K, 112C, 112M and 112Y, and the tanks are communicated with the heads 112K, 112C, 112M and 112Y via necessary pipe lines. Further, the ink storing unit 114 is disposed with an informing unit that informs an operator when remaining amounts of the inks become small, and the ink storing unit 114 includes a mechanism for preventing erroneous filling between colors.

In FIG. 1, there is shown a magazine of roll paper (continuous paper) as one example of the paper supplying unit 118. The inkjet recording apparatus 110 may also be disposed with plural magazines whose paper width and paper quality are different. Further, instead of, or in joint use together with, a magazine of roll paper, the paper may also be supplied by a cassette into which cut paper has been stacked and loaded.

When the inkjet recording apparatus 110 is configured to be capable of utilizing plural types of recording media, it is preferred to automatically distinguish the type of recording medium (media types) to be used by attaching to the magazine an information recording body such as a barcode or a wireless tag in which media type information is recorded and reading the information of that information recording body with a predetermined reading device and to perform ink ejection control so as to realize appropriate ink ejection in accordance with the media types.

The recording paper 116 that is fed from the paper supplying unit 118 curls as a result of having been loaded in the magazine. In order to decurl the recording paper 116, in the decurling unit 120, heat is applied to the recording paper 116 by a heating drum 130 in the opposite direction of the curling direction of the magazine. At this time, it is more preferred to control the heating temperature such that a printing surface of the recording paper 116 somewhat weakly curls outward.

In the case of an apparatus configuration that uses roll paper, as shown in FIG. 1, a cutter 128 for cutting is disposed such that the roll paper is cut into a desired size by the cutter 128. It will be noted that, in a case where the apparatus uses cut paper, the cutter 128 is unnecessary.

The recording paper 116 that has been cut after having been decurled is fed to the belt conveyance unit 122. The belt conveyance unit 122 is configured to have a structure where an endless belt 133 is wrapped between rollers 131 and 132.

The belt 133 has a width dimension that is wider than the width of the recording paper 116, and numerous suction holes (not shown) are formed in the belt surface. As shown in FIG. 1, an adsorption chamber 134 is disposed in a position facing the nozzle surface of the printing unit 112 on the inner side of the belt 133 wrapped between the rollers 131 and 132. This adsorption chamber 134 is sucked and placed in a negative pressure state by a fan 135, whereby the recording paper 116 is adsorbed to and held on the belt 133. It will be noted that, instead of a suction adsorption format, an electrostatic adsorption format may also be employed.

Motive power of an unillustrated motor is transmitted to at least one of the rollers 131 and 132 around which the belt 133 is wrapped, whereby the belt 133 is driven in a clockwise direction in FIG. 1, and the recording paper 116 held on the belt 133 is conveyed from left to right in FIG. 1.

When the inkjet recording apparatus 110 prints a marginless print or the like, the inks also adhere to the top of the belt 133, so a belt cleaning unit 136 is disposed in a predetermined position on the outer side of the belt 133 (an appropriate position outside of a printing region). Although details are not shown in regard to the configuration of the belt cleaning unit 136, there are, for example, a format that nips a brush roll or a water-absorbing roll, an air blow format that blows cleaning air, or a combination of these. In the case of a format that nips a cleaning roll, the cleaning effect is large when the belt linear velocity and the roller linear velocity are changed.

It will be noted that, instead of the belt conveyance unit 122, an aspect that uses a roller nip conveyance mechanism is also conceivable. When the printing region is nipped between and conveyed by rollers, the rollers contact the printing surface of the paper immediately after printing, so it is easy for the image to run (color blurring occurs). Consequently, adsorption belt conveyance that does not contact the image surface in the printing region, as in the present example, is preferred.

A heating fan 140 is disposed on the upstream side of the printing unit 112 on a paper conveyance path formed by the belt conveyance unit 122. The heating fan 140 blows hot air onto the recording paper 116 before printing and heats the recording paper 116. By heating the recording paper 116 immediately before printing, it becomes easier for the inks to dry after they land.

Figure 2:
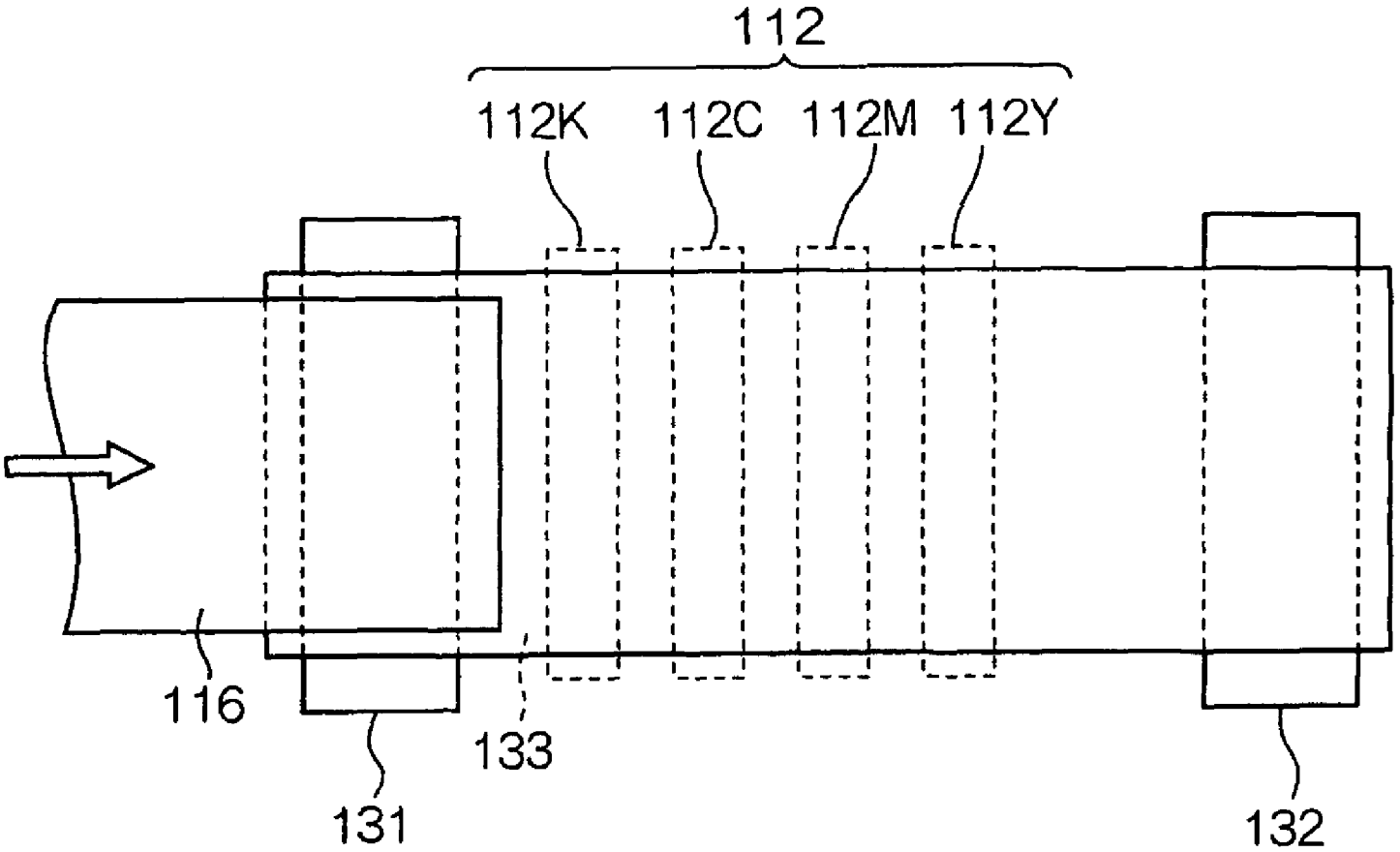
FIG. 2 is a plan view showing a configuration of a printing part and a vicinity thereof in the ink-jet recording apparatus according to the exemplary embodiment.

The heads 112K, 112C, 112M and 112Y of the printing unit 112 have a length corresponding to the maximum paper width of the recording paper 116 intended for the inkjet recording apparatus 110. The heads are full-line heads, and nozzles for ink ejection are plurally arrayed on their nozzle surfaces across a length extending beyond at least one side of the maximum-size recording paper 116 (the entire width of the drawable range) (see FIG. 2).

The heads 112K, 112C, 112M and 112Y are arranged in the color order of black (K), cyan (C), magenta (M) and yellow (Y) from the upstream side along a feeding direction of the recording paper 116. The heads 112K, 112C, 112M and 112Y are fixedly installed so as to extend along a direction substantially orthogonal to the conveyance direction of the recording paper 116.

The inks of the respectively different colors are ejected onto the recording paper 116 from the heads 112K, 112C, 112M and 112Y while the recording paper 116 is conveyed by the belt conveyance unit 122, whereby a color image can be formed on the recording paper 116.

In this manner, according to the configuration where the full-line heads 112K, 112C, 112M and 112Y that include nozzle rows covering the entire region of the paper width are disposed separately by color, an image can be recorded on the entire surface of the recording paper 116 simply by performing, one time (that is, one-time sub-scanning), operation of causing the recording paper 116 and the printing unit 112 to relatively move in regard to the paper feeding direction (a sub-scanning direction). Thus, the heads are capable of high-speed printing in comparison to a shuttle head where the recording head reciprocally operates in a direction orthogonal to the paper conveyance direction, and productivity can be improved.

In the present example, there is exemplified a configuration of the standard colors (four colors) KCMY, but the combination of ink colors and number of colors is not limited to the present embodiment. Light inks, dark inks and special color inks may also be added as needed. For example, a configuration that adds inkjet heads that eject light inks such as light cyan and light magenta is also possible. Further, there is no particular limitation on the arrangement order of the color heads.

A post-drying unit 142 is disposed downstream of the printing unit 112 on the paper conveyance route formed by the belt conveyer 122. The post-drying unit 142 is means that dries the image surface that has been printed, and, for example, a heating fan is used. It is preferable to avoid contacting the printing surface until the inks after printing have dried, so a format that blows hot air is preferred.

In a case where dye-based inks are printed on porous paper, there is the effect that weatherability of the image increases because contact with things such as ozone that cause destruction of dye molecules is prevented because the holes in the paper are filled in by pressurization.

A heating/pressuring unit 144 is disposed downstream of the post-drying unit 142. The heating/pressuring unit 144 is means for controlling the glossiness of the image surface. The heating/pressuring unit 144 pressures, while heating, the image surface with a pressure roller 145 having a predetermined surface-uneven shape and transfers the uneven shape to the image surface.

The print matter that has been produced in this manner is discharged from the paper discharging unit 126. Normally it is preferred to separate and discharge an actual image that is to be printed (something on which a target image has been printed) from test printing.

In this inkjet recording apparatus 110, there is disposed sorting means (not shown) that sorts between print matter of an actual image and print matter of test printing and switches the paper discharge path in order to send these to respective discharging units 126A and 126B.

It will be noted that, when an actual image and test printing are simultaneously formed in parallel on large paper, the test printing portion is cut off by a cutter 148. Further, in the discharging unit 126A of an actual image, there is disposed a sorter (not shown) that accumulates images separately by order.

Next, the structure of the heads will be described. The color-separate heads 112K, 112C, 112M and 112Y have the same structure, so below, reference numeral 150 will represent these heads.

Figure 3:
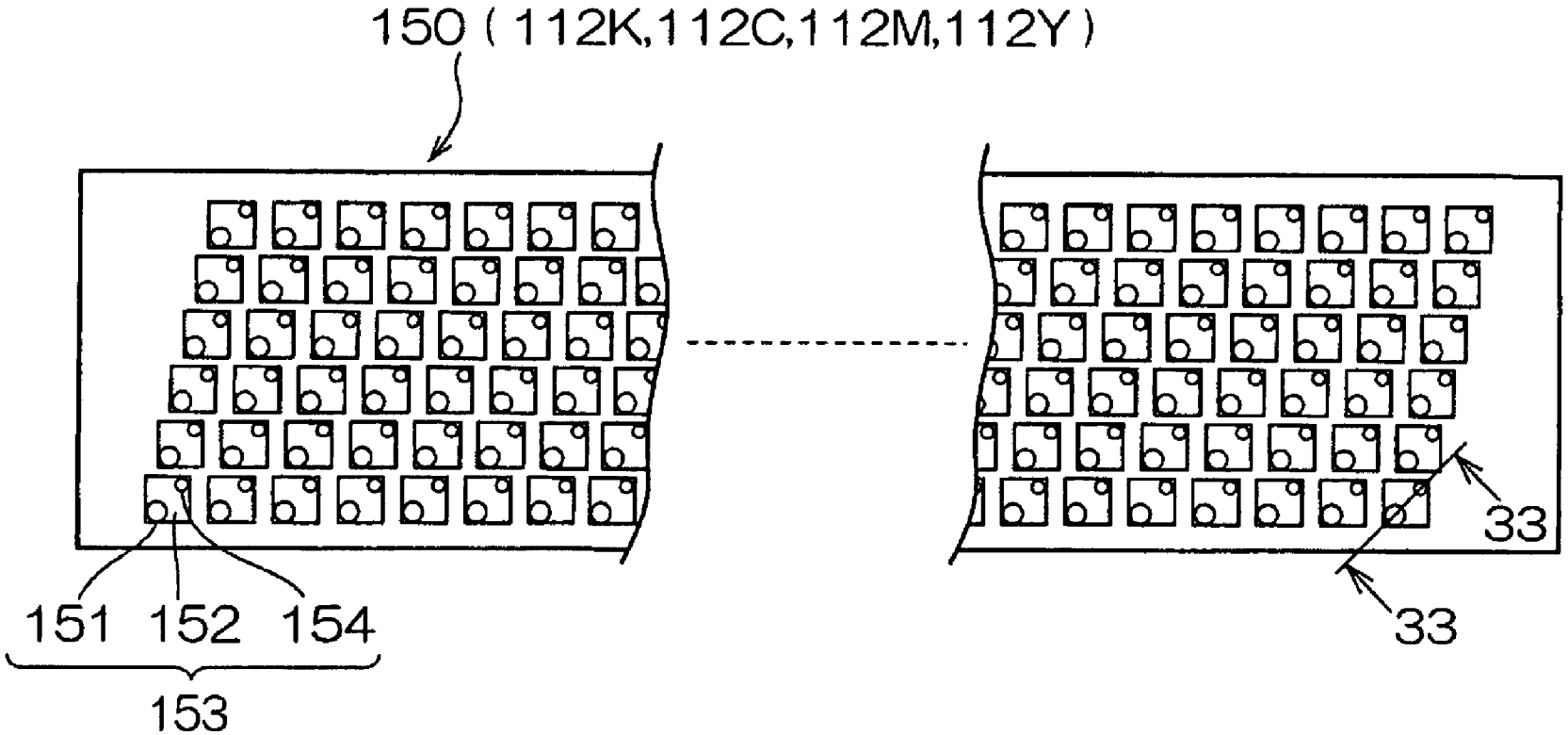
FIG. 3 is a plan perspective view showing a configuration example of a head of the ink-jet recording apparatus according to the exemplary embodiment.
Figure 4:
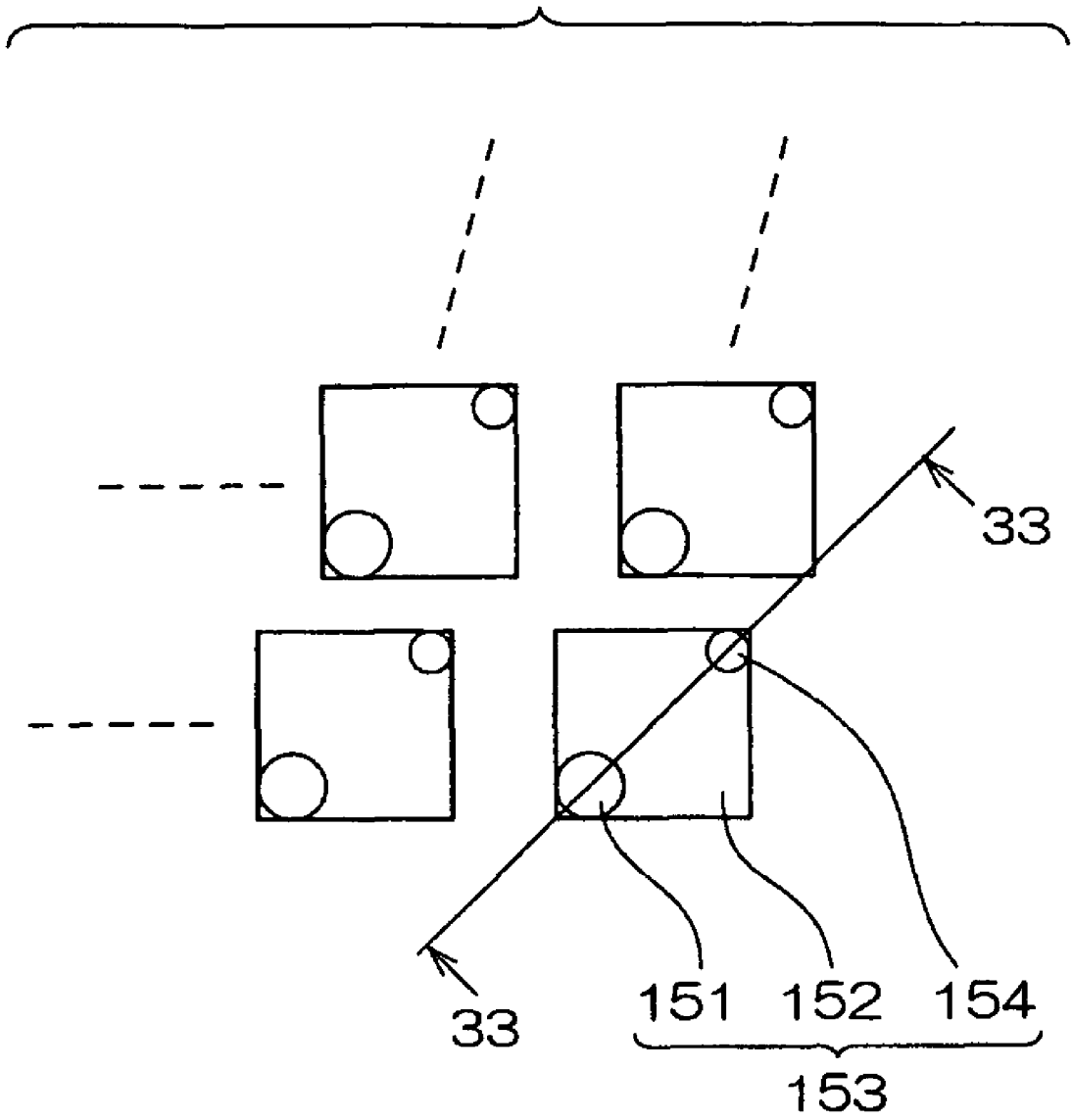
FIG. 4 is an enlarged diagram of ink chamber units in FIG. 3.
Figure 5:
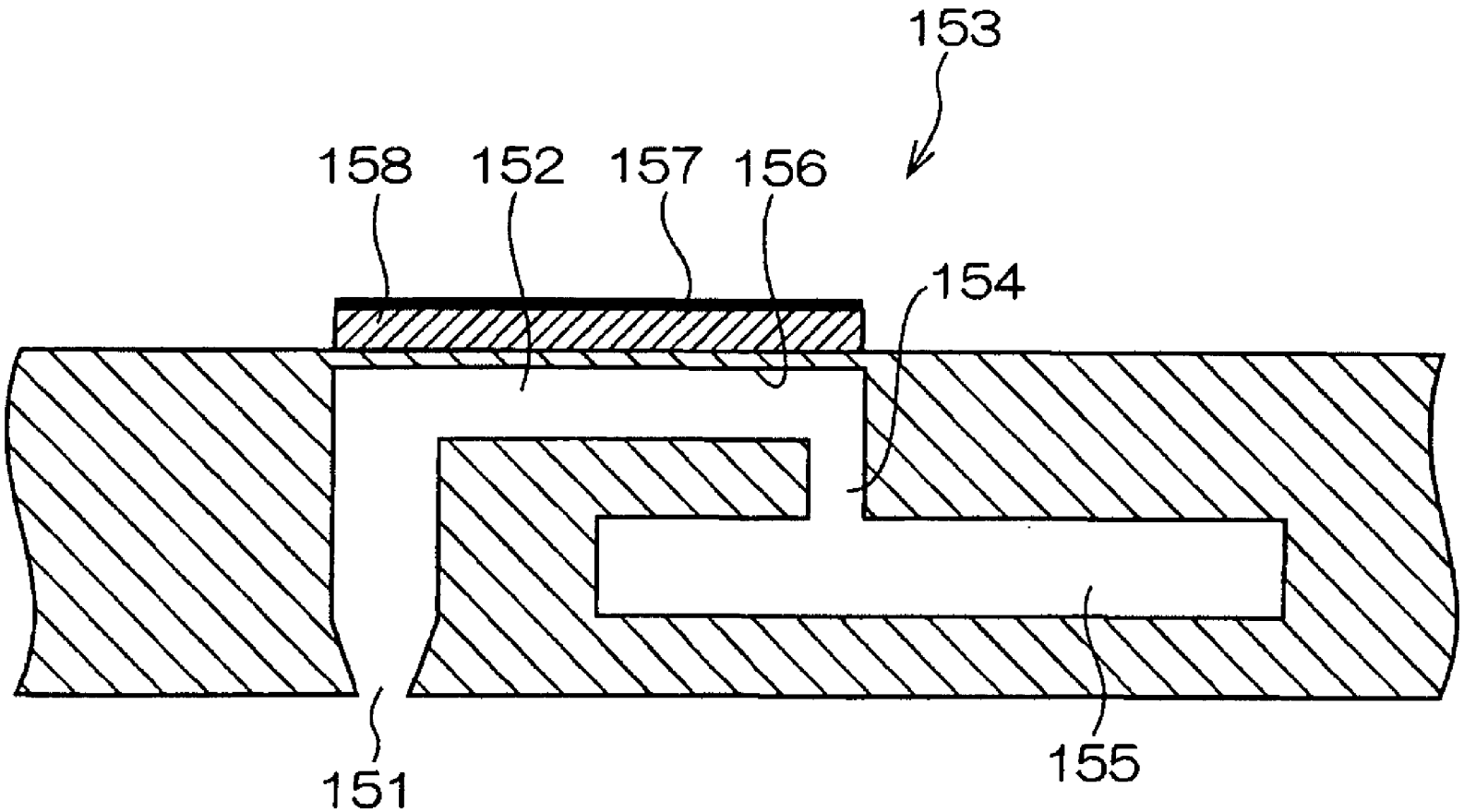
FIG. 5 is a cross-sectional diagram along 33-33 section line in FIG. 3.

FIG. 3 is a plan transparent diagram showing a structural example of the head 150, and FIG. 4 is an enlarged diagram of part of FIG. 3. Further, FIG. 5 is a cross-sectional diagram (a cross-sectional diagram along line 33-33 in FIG. 4) showing the three-dimensional configuration of one liquid droplet ejecting element (an ink chamber unit corresponding to one nozzle 151).

In order to densify the pitch of the dots to be printed on the recording paper 116, it is necessary to densify the pitch of the nozzles in the head 150. In the head 150 of the present example, as shown in FIG. 3 and FIG. 4, plural ink chamber units (liquid droplet ejecting elements) 153, each of which includes a nozzle 151 that is an ink ejection opening and a pressure chamber 152 that corresponds to the nozzle 151, are staggeringly arranged in a in a matrix (two-dimensionally). Thus, densification of the substantial inter-nozzle distance (projected nozzle pitch) projected so as to be along the head longitudinal direction (direction orthogonal to the paper feeding direction) is achieved.

It will be noted that the mode of configuring one or more nozzle rows across a length corresponding to the entire width of the recording paper 116 in a direction substantially orthogonal to the feeding direction of the recording paper 116 is not limited to the present embodiment.

Each of the pressure chambers 152 that are disposed in correspondence to the nozzles 151 has a generally square planar shape (see FIG. 3 and FIG. 4), with an outflow opening that leads to the nozzle 151 being disposed in one of both corner portions on a diagonal line and with a supply ink inflow opening (supply opening) 154 being disposed in the other of the corner portions on the diagonal line. It will be noted that the shape of the pressure chambers 152 is not limited to the shape in the present example and that a wide variety of configurations are possible. For example, the pressure chambers 152 may also have a quadrilateral (rhombic, rectangular, etc.), pentagonal, hexagonal or other polygonal planar shape, or the pressure chambers 152 may also have a circular or elliptical planar shape.

As shown in FIG. 5, each of the pressure chambers 152 is communicated with a common flow path 155 via the supply opening 154. The common flow path 155 is communicated with an ink tank (not shown) that is an ink supply source, and ink supplied from the ink tank is distributed and supplied to each of the pressure chambers 152 via the common flow path 155.

An actuator 158 disposed with an individual electrode 157 is joined to a pressure plate (diaphragm that doubles as a common electrode) 156 that configures a surface (in FIG. 5, a ceiling surface) of part of the pressure chamber 152.

It will be noted that a piezoelectric element using a piezoelectric body such as lead zirconate titanate or barium titanate is suitably used for the actuator 158.

A drive voltage is supplied between the individual electrode 157 and the common electrode, whereby the actuator 158 deforms, the volume of the pressure chamber 152 changes, and the ink is ejected from the nozzle 151 by an accompanying change in pressure. After ink ejection, when displacement of the actuator 158 returns to before, the pressure chamber 152 is refilled with new ink via the supply opening 154 from the common flow path 155.

Accordingly, in the ink-jet recording apparatus 110 according to the first exemplary embodiment, by controlling the driving of the actuators 158 corresponding to the nozzles 151 in accordance with dot arrangement data produced from image information, ink droplets can be ejected from the nozzles 151. As has been described in FIG. 1, the inkjet recording apparatus 110 controls the ink ejection timings of the nozzles 151 to match the conveyance speed of the recording paper 116 while conveying the recording paper 116 that is a recording medium at a constant speed in the sub-scanning direction. In this manner, the inkjet recording apparatus 110 can record a desired image on the recording paper 116.

Figure 6:
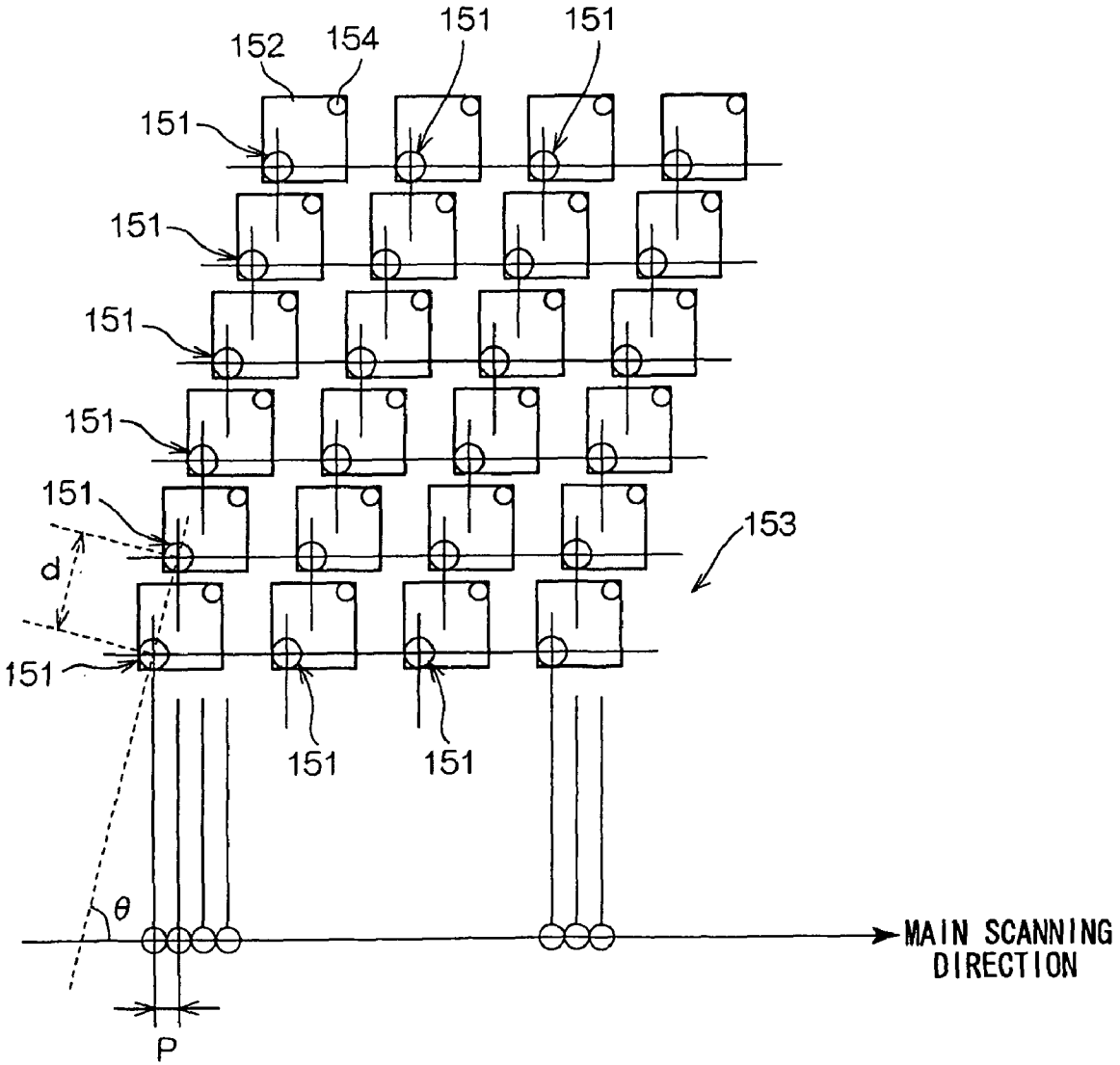
FIG. 6 is a schematic diagram showing one example of a nozzle array of the head of the ink-jet recording apparatus according to the exemplary embodiment.

The ink chamber units 153 are, as shown in FIG. 6, numerously arrayed in a lattice manner in a constant array pattern along a column direction along a main scanning direction and a diagonal row direction having a constant angle θ that is not orthogonal with respect to the main scanning direction. Thus, the high-density nozzle head of the present example is realized.

That is, the ink chamber units 153 are plurally arrayed at a constant pitch d along the direction of the certain angle θ with respect to the main scanning direction. A pitch P of the nozzles projected so as to be along the main scanning direction becomes equal to $d \times \cos\theta$. In regard to the main scanning direction, the nozzles 151 can be treated equivalently as being arrayed in a straight line at the constant pitch P. Because of this configuration, it becomes possible for the nozzle rows projected so as to be along the main scanning direction to realize a high-density nozzle configuration of 2400 per inch (2400 nozzles/inch).

"Sub-scanning" is defined as repeatedly performing printing of one line (a line resulting from one row of dots or a line including plural rows of dots) that has been formed by the aforementioned main scanning by relatively moving the aforementioned full-line head and the paper.

Additionally, "main scanning direction" refers to the direction represented by one line (or the longitudinal direction of a band-like region) that is recorded by the aforementioned main scanning, and "sub-scanning direction" refers to the direction in which the aforementioned sub-scanning is performed. That is, in the present embodiment, the conveyance direction of the recording paper 116 is the sub-scanning direction, and the direction orthogonal to that is the main scanning direction.

Figure 7:
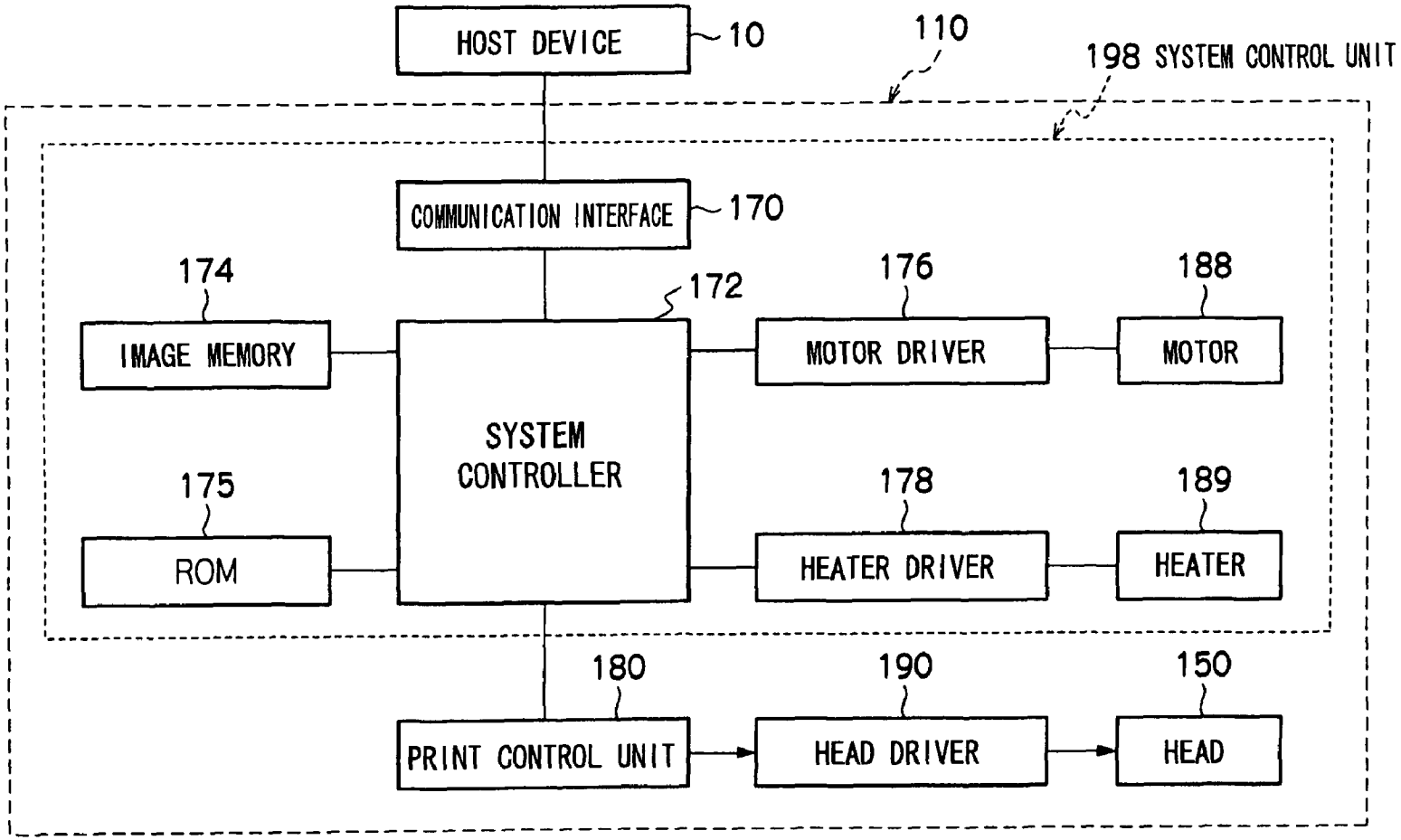
FIG. 7 is a block diagram showing an essential configuration of an electric system of the ink-jet recording apparatus according to the exemplary embodiment.

FIG. 7 is a block diagram showing an essential configuration of an electric system of the ink-jet recording apparatus 110.

As shown in FIG. 7, the ink-jet recording apparatus 110 includes a head 150, a system control unit 198, a print controller 180 and a head driver 190.

The system control unit 198 includes a communication interface 170, a system controller 172, an image memory 174, a ROM 175, a motor driver 176, a heater driver 178 and the like.

The communication interface 170 is an interface unit for interfacing with a host device 10 that is used in order for the operator to issue a printing instruction or the like with respect to the inkjet recording apparatus 110. A serial interface, such as Universal Serial Bus (USB), IEEE 1394, Ethernet® or a wireless network, or a parallel interface, such as the Centronics parallel interface, can be applied as the communication interface 170. A buffer memory (not shown) for increasing the speed of communication may also be installed in this portion.

Image data that have been sent from the host device 10 are inputted to the inkjet recording apparatus 110 via the communication interface 170 and are temporarily stored in the image memory 174. The image memory 174 is storage unit that stores images that have been inputted via the communication interface 170, and data reading and writing are performed via the system controller 172. The image memory 174 is not limited to a memory including a semiconductor element, and a magnetic medium such as a hard disk may also be used.

The system controller 172 is configured by a central processing unit (CPU) and peripheral circuits, functions as a control device that controls the entire inkjet recording apparatus 110 in accordance with a predetermined program, and also functions as a processing unit that performs various types of processing. That is, the system controller 172 controls the communication interface 170, the image memory 174, the motor driver 176, the heater driver 178 and the print control unit 180, controls communication with the host device 10, and controls reading and writing of the image memory 174 and the ROM 175. Further, the system controller 172 generates control signals that control a motor 188 of the conveyance system and a heater 189. It will be noted that, in addition to control signals, the system controller 172 transmits the image information stored in the image memory 174 to the print control unit 180.

Further, programs that the CPU of the system controller 172 executes and various types of data necessary for control are stored in the ROM 175. The ROM 175 may also be a non-rewritable storage unit. When various types of data are to be updated as needed, it is preferred to use a rewritable storage unit such as an EEPROM.

The image memory 174 is utilized as a temporary storage region for image data and is also utilized as a program development region and a CPU processing work region.

The motor driver 176 is a driver (drive circuit) that drives the motor 188 of the conveyance system in accordance with an instruction from the system controller 172. The heater driver 178 is a driver that drives the heater 189 of the post-drying unit 142 in accordance with an instruction from the system controller 172.

The print controller 180 controls the head 150 via the head driver 190 based on the image information transmitted from the system control unit 198 in accordance with the control of the system controller 172.

Figure 8:
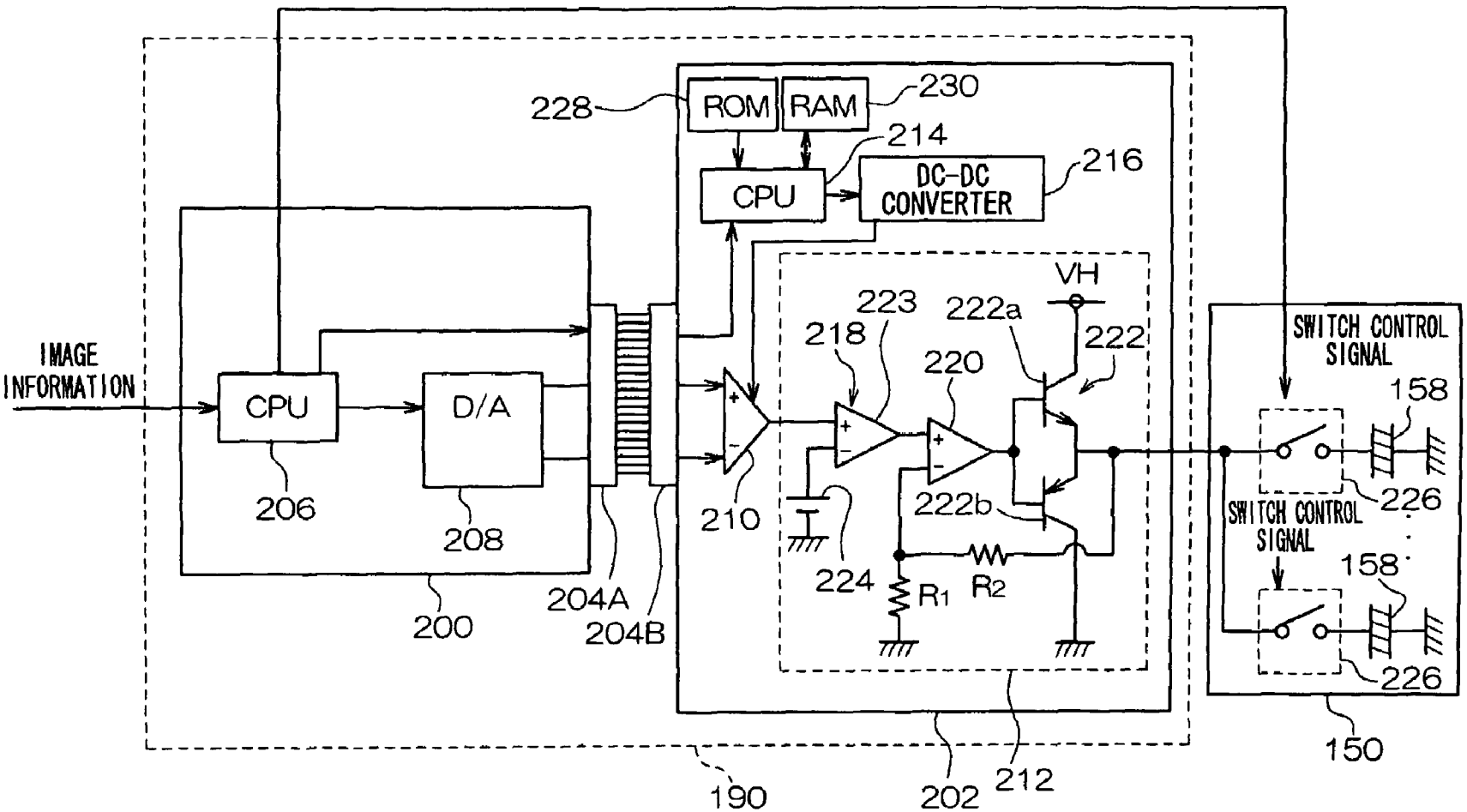
FIG. 8 is a configuration diagram showing a configuration of the head and a head driver of the ink-jet recording apparatus according to a first exemplary embodiment.

FIG. 8 is a configuration diagram showing a configuration of the head 150 and the head driver 190 of the ink-jet recording apparatus 110 according to the first exemplary embodiment.

As shown in FIG. 8, the head driver 190 includes a first circuit board 200 and a second circuit board 202. The first circuit board 200 and the second circuit board 202 are mechanically connected by a connector 204A and a connector 204B via a harness. Hereinafter, when it is not necessary to discriminate the connector 204A and the connector 204B each other, they are simply referred to as a "connector 204".

The first circuit board 200 includes the CPU 206 and a digital/analog converter (hereinafter, referred to as a "D/A converter") 208.

The CPU 206 is connected to the print controller 180 to control actuation of the head 150 and the head driver 190 based on the image information input from the print controller 180. In the ink-jet recording apparatus 110 according to the first exemplary embodiment, the CPU 206 generates a digital signal which indicates a voltage as a reference of a voltage to be applied to the actuator 158 based on the image information input from the print controller 180, and outputs the digital signal to the D/A converter 208.

Figure 9:
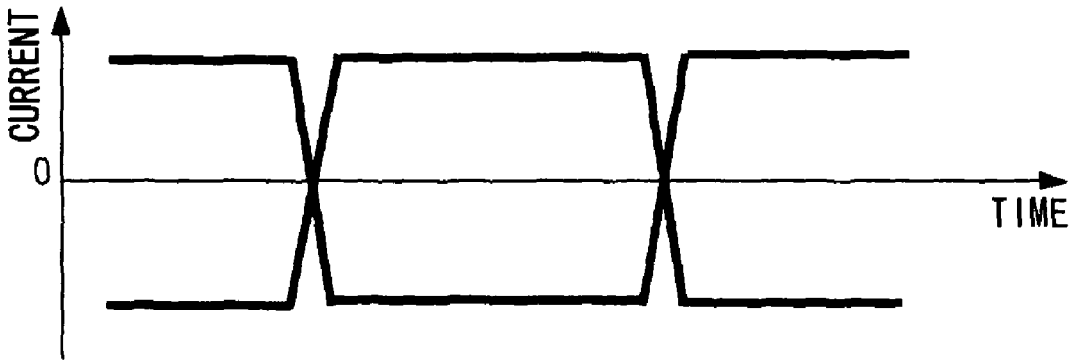
FIG. 9 is a schematic diagram showing a waveform of an analog signal differentially output from a D/A converter of the ink-jet recording apparatus according to the first exemplary embodiment.

The D/A converter 208 converts the digital signal input from the CPU 206 to an analog signal to output. In the ink-jet recording apparatus 110 according to the first exemplary embodiment, the analog signal is differentially output by the D/A converter 208 as shown in FIG. 9, for example.

The second circuit board 202 includes a differential amplifier circuit 210, an amplifier 212, a CPU 214, a DC-DC converter 216, a ROM 228 and a RAM 230.

The differential amplifier circuit 210 is connected to an output terminal of the D/A converter 208 at an input terminal thereof via the connector 204, such that the analog signal differentially output from the D/A converter 208 is input to the differential amplifier circuit 210, and the analog signal is differentially amplified to be output from the differential amplifier circuit 210.

The amplifier 212 includes a level shift circuit 218, an operational amplifier 220, and a current amplifier circuit 222.

The level shift circuit 218 includes an operational amplifier 223 and a DC power source 224. In the operational amplifier 223, a noninverting input terminal thereof is connected to an output terminal of the differential amplifier circuit 210, an inverting input terminal thereof is connected to a plus terminal of the DC power source 224 of which a minus terminal is grounded, and an output terminal thereof is connected to a noninverting input terminal of the operational amplifier 220, respectively. The operational amplifier 223 increases a voltage level of the analog signal which is input from the differential amplifier circuit 210 by a predetermined voltage level (a voltage level which is determined in advance such that it is possible for the head 150 to perform favorable droplet ejection) to output to the operational amplifier 220.

In the operational amplifier 220, an inverting input terminal thereof is grounded via a resister $R_1$, and an output terminal thereof is connected to an input terminal of the current amplifier circuit 222. The operational amplifier 220 amplifies the voltage of the analog signal which is input from the level shift circuit 218 to output to the current amplifier circuit 222.

The current amplifier circuit 222 includes an NPN transistor 222*a* and a PNP transistor 222*b*. The current amplifier circuit 222 amplifies a current of the analog signal input from the operational amplifier 220 to output to the head 150. In the NPN transistor 222*a*, a base thereof is connected to an output terminal of the operational amplifier 220, a collector thereof is connected to a DC power source VH, and an emitter thereof is connected to an emitter of the PNP transistor 222*b*, respectively. In the PNP transistor 222*b*, a base thereof is connected to the output terminal of the operational amplifier 220, and a collector thereof is connected to a ground, respectively. Moreover, the respective emitters of the NPN transistor 222*a* and the PNP transistor 222*b* are connected to the inverting input terminal of the operational amplifier 220 via a resistor $R_2$.

The DC-DC converter 216 supplies an electric power for drive to the differential amplifier circuit 210, such that the differential amplifier circuit 210 is actuated by being supplied the electric power.

The CPU 214 controls the actuation of the respective units on the second circuit board 202. The CPU 214 is connected to the ROM 228 and the RAM 230, respectively. Moreover, the CPU 214 is connected to the CPU 206 via the connector 204. The CPU 214 is also connected to the DC-DC converter 216.

In the ROM 228, a program that the CPU 214 executes, various types of data necessary for the control and the like are stored. The RAM 230 is utilized as a temporary storage area of the various types of data, and is also utilized as a developing area of the program and an arithmetic operation working area of the CPU 214.

The head 150 includes plural switches 226 which correspond to the respective actuators 158.

Each of the switches 226 is a single-pole single-throw switch, and performs switching between two states of connection and non-connection between an output terminal of the current amplifier circuit 222 and the actuator 158.

The respective switches 226 are connected to the CPU 206. The CPU 206 generates a switch control signal that controls each of the switches 226, and outputs the signal to the corresponding switch 226.

In the first exemplary embodiment, when the switch control signal is at a high level, the corresponding switch 226 is in an ON state, and when the switch control signal is at a low level, the corresponding switch 226 is in an OFF state, however, the structure is not limited to this. The configuration may be such that when the switch control signal is at a low level, the corresponding switch 226 is in an ON state, and when the switch control signal is at a high level, the corresponding switch 226 is in an OFF state.

Next, the operation of the ink-jet recording apparatus 110 according to the first exemplary embodiment is described.

In the ink-jet recording apparatus 110 according to the first exemplary embodiment, the CPU 206 provided in the first circuit board 200 outputs the predetermined signal to the second circuit board 202 via the connector 204. Moreover, when the image information is input from the print controller 180 to the CPU 206, the CPU 206 generates the digital signal and the switch control signal based on the image information, and outputs the digital signal to the D/A converter 208 and outputs the switch control signal to each of the switches 226. In the D/A converter 208, the digital signal input from the CPU 206 is converted to the analog signal, and the analog signal is output to the second circuit board 202 via the connector 204.

In the CPU 214 provided in the second circuit board 202, voltage-application control processing is executed.

Figure 10:
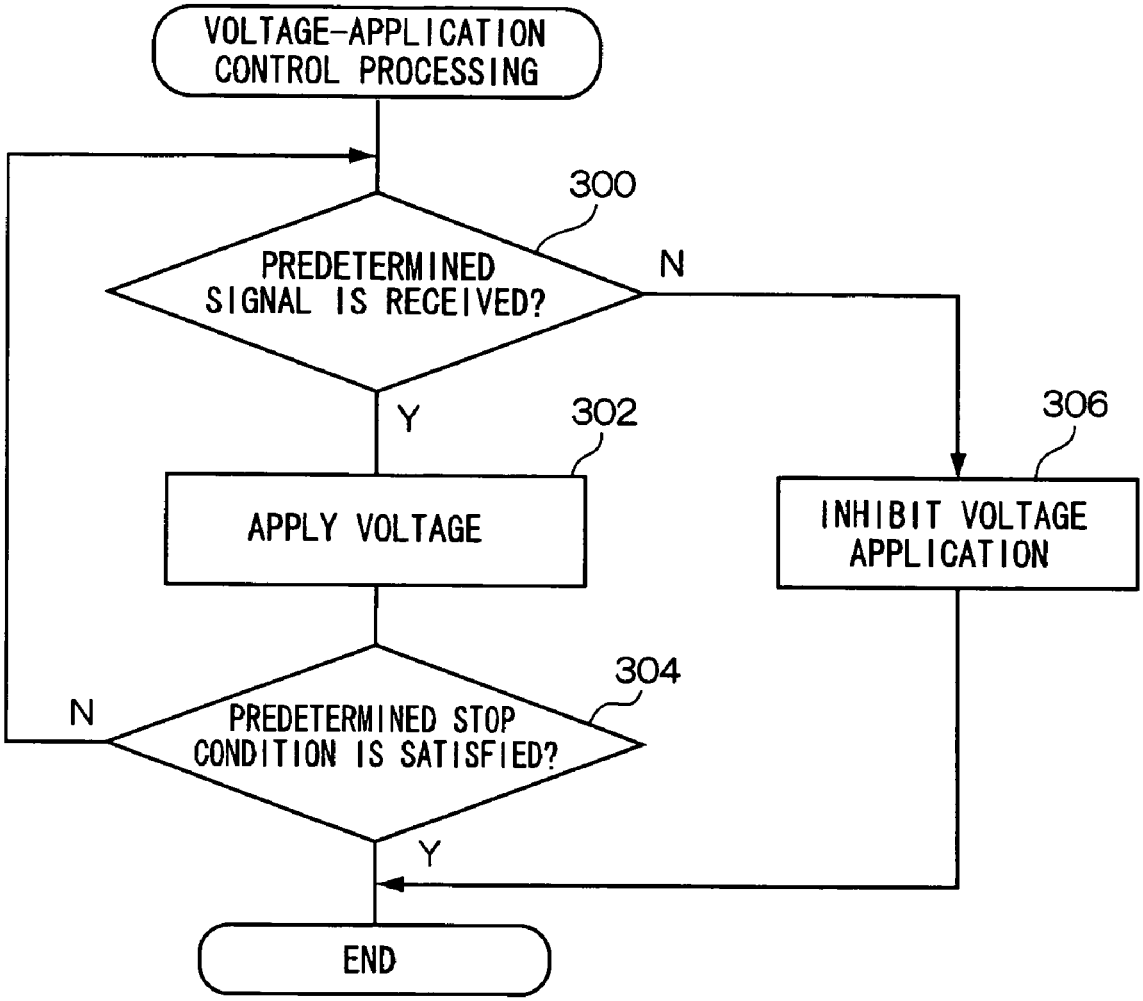
FIG. 10 is a flowchart showing a flow of processing of a voltage-application control processing program according to the first exemplary embodiment.

Hereinafter, referring to FIG. 10, the operation of the second circuit board 202 in the voltage-application control processing is described. FIG. 10 is a flowchart showing a flow of the processing of a voltage-application control processing program executed by the CPU 214. The program is stored in a predetermined area of the ROM 228 in advance.

In step 300 of FIG. 10, it is determined whether or not the predetermined signal output from the CPU 206 is received. If the determination is affirmative, the processing goes to step 302. Control is performed so as to apply the voltage of the analog signal to the actuator 158 via the switch 226 (hereinafter, referred to as "voltage application control"), and the processing goes to step 304.

In the ink-jet recording apparatus 110 according to the first exemplary embodiment, as the above-described voltage application control, control for actuating the differential amplifier circuit 210 (as one example, processing for causing the DC-DC converter 216 to supply the electric power for drive to the differential amplifier circuit 210) is applied.

The voltage application control is not limited to the foregoing. For example, a switch for switching between two states of connection and disconnection of a connection wiring between the differential amplifier circuit 210 and the level shift circuit 218 may be provided to thereby apply processing for controlling the switch such that the differential amplifier circuit 210 and the level shift circuit 218 are put into the connection state. Alternatively, a switch for switching between two states of connection and disconnection of a connection wiring between the level shift circuit 218 and the operational amplifier 220 may be provided to thereby apply processing for controlling the switch such that the level shift circuit 218 and the operational amplifier 220 are put into the connection state. Still alternatively, a switch for switching between two states of connection or disconnection of a connection wiring between the current amplifier circuit 222 and the switch 226 may be provided to thereby apply processing for controlling the switch such that the current amplifier circuit 222 and the switch 226 are put into the connection state.

In this manner, for the above-described voltage application control, any processing for performing the control so as to apply the voltage of the analog signal to the actuator 158 via the switch 226 may be applied.

In step 304, it is determined whether or not a condition for stopping the image formation (printing) is satisfied. If the determination is negative, the processing returns to step 300, while, if the determination is affirmative, the voltage-application control processing program is ended.

While in the ink-jet recording apparatus 110 according to the first exemplary embodiment, as the condition for stopping image formation, a condition that the electric power switch of the ink-jet recording apparatus 110 is turned off is applied, however, the condition is not limited to this. For example, a condition that the recording paper 116 in the paper feeding unit 34 is used up, a condition that there occurs a failure which is determined in advance as a failure which would disables favorable image formation in the ink-jet recording apparatus 110, and so on may be applied.

On the other hand, if the determination is negative in step 300, the processing goes to step 306. The control is performed so as to inhibit (prevent) the voltage of the analog signal from being applied to the actuator 158 via the switch 226 (hereinafter, referred to as "voltage-application inhibition control"), and the voltage-application control processing program is ended.

In the ink-jet recording apparatus 110 according to the first exemplary embodiment, as the above-described voltage-application inhibition control, control to inhibit the differentiate amplifier circuit 210 from being actuated (as one example, processing of inhibiting the DC-DC converter 216 from supplying the electric power for drive to the differential amplifier circuit 210) is applied.

The voltage-application inhibition control is not limited to the foregoing. For example, the switch for switching between two states of connection and disconnection of a connection wiring between the differential amplifier circuit 210 and the level shift circuit 218 may be provided to thereby apply processing for controlling the switch such that the differential amplifier circuit 210 and the level shift circuit 218 are put into the non-connection state. Alternatively, the switch for switching between two states of connection or disconnection of a connection wiring between the level shift circuit 218 and the operational amplifier 220 may be provided to thereby apply processing for controlling the switch such that the level shift circuit 218 and the operational amplifier 220 are put into the non-connection state. Still alternatively, the switch for switching between two states of connection or disconnection of a connection wiring between the current amplifier circuit 222 and the switch 226 may be provided to thereby apply processing for controlling the switch such that the current amplifier circuit 222 and the switch 226 are put into the non-connection state.

In this manner, for the above-described voltage-application inhibition control, any processing for performing the control so as to inhibit the voltage of the analog signal from being applied to the actuator 158 via the switch 226 may be applied.

As described above in detail, the ink-jet recording apparatus 110 according to the first exemplary embodiment includes the first circuit board 200 having the D/A converter 208, the second circuit board 202 having the operational amplifier 220, the connector 204, the transmitter (CPU 206) which is provided in the first circuit board 200, and the controller (CPU 214). The D/A converter 208 converts, to the analog signal, the digital signal as the reference of the voltage to be applied to the capacitive load (the actuator 158) and outputs the analog signal. The operational amplifier 220 is connected to the capacitive load at the output terminal thereof via the switching element (switch 226) and amplifies the voltage of the analog signal to output. The connector 204 mechanically connects the first circuit board 200 and the second circuit board 202 such that the analog signal output from the D/A converter 208 is input to the input terminal of the operational amplifier 220. The transmitter transmits the predetermined signal to the second circuit board 202 via the connector 204. When the predetermined signal is not received in the second circuit board 202, the controller performs the control so as to inhibit the voltage of the analog signal from being applied to the capacitive load via the switching element. Thereby, if the predetermined signal which is supposed to be received via the connector 204 is not received, it is considered that poor connection in the connector 204 occurs, and the control is performed so as to inhibit the voltage of the analog signal from being applied to the capacitive load via the switching element. Accordingly, damage of the switching element attributed to the poor connection of the connector 204 can be prevented.

Moreover, in the ink-jet recording apparatus 110 according to the first exemplary embodiment, the D/A converter 208 differentially outputs the analog signal, and the ink-jet recording apparatus 110 further includes the differential amplifier circuit 210 that is provided in a preceding stage of the operational amplifier 220 in the second circuit board 202. The analog signal output differentially from the D/A converter 208 is input to the second circuit board 202, and the second circuit board 202 differentially amplifies the analog signal. This can reduce noise superimposed on the analog signal in a portion of the connector 204 in the second circuit board 202.

Furthermore, in the ink-jet recording apparatus 110 according to the first exemplary embodiment, the controller performs the control to inhibit the differential amplifier circuit 210 from being actuated to thereby perform the control so as to inhibit the voltage of the analog signal from being applied to the capacitive load. This may prevent the damage of the switching element attributed to poor connection of the connector 204 at low cost and with certainty.

Second Exemplary Embodiment

Next, a second exemplary embodiment is described. In the second exemplary embodiment, the same reference numerals are given to the same parts as those in the first exemplary embodiment, and their descriptions are omitted.

Figure 11:
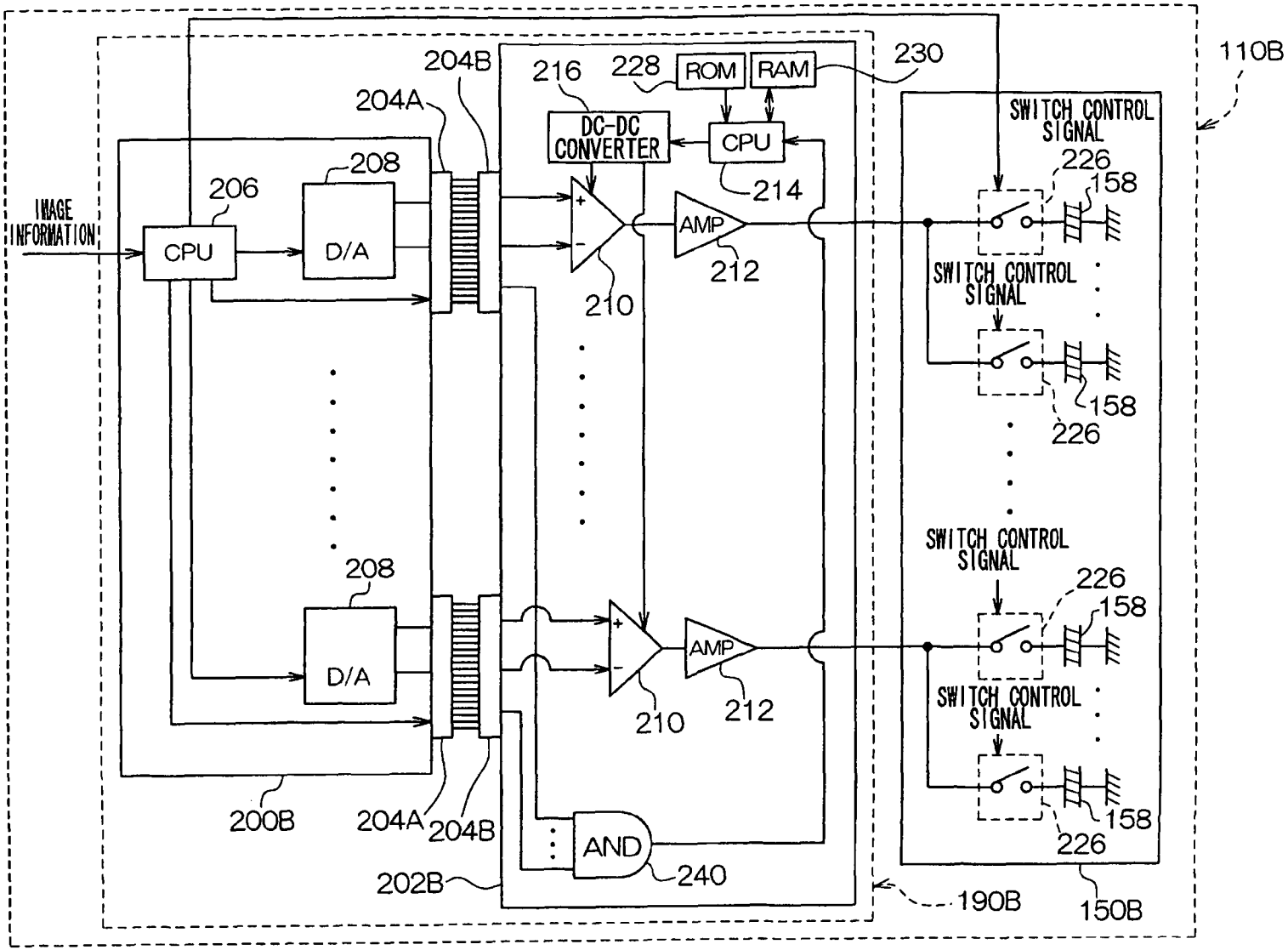
FIG. 11 is a configuration diagram showing a configuration of a head and a head driver of an ink-jet recording apparatus according to a second exemplary embodiment.
Figure 12:
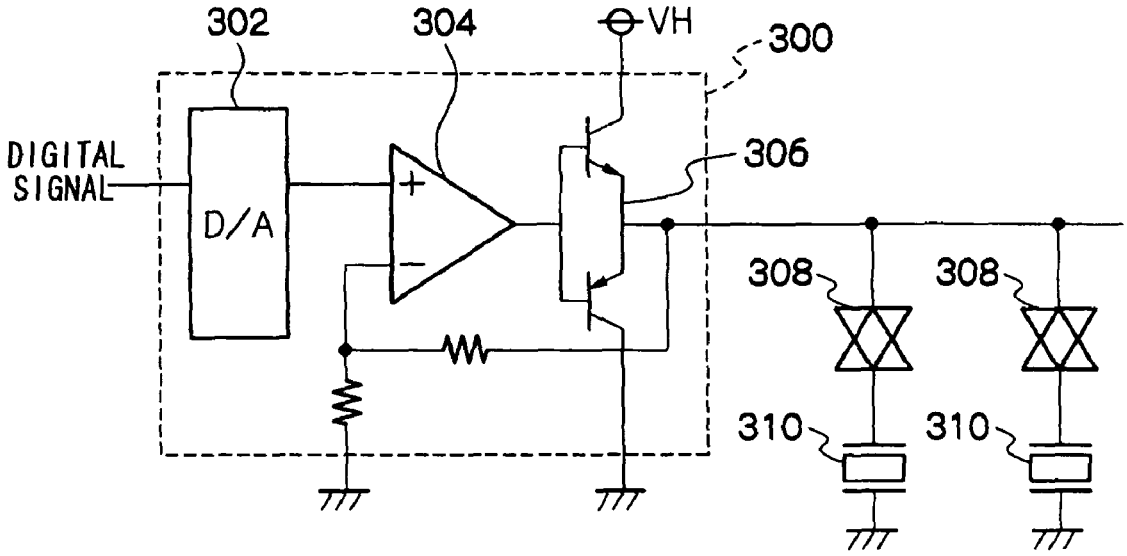
FIG. 12 RELATED ART
FIG. 12 is a configuration diagram showing a configuration of a drive circuit that applies a voltage to a piezoelectric element in a conventional droplet ejection apparatus.

FIG. 11 is a configuration diagram showing a configuration of a head 150B and a head driver 190B of an ink-jet recording apparatus 110B according to the second exemplary embodiment.

As shown in FIG. 11, the ink-jet recording apparatus 110B is different from the ink-jet recording apparatus 110 described in the first exemplary embodiment only in that the head 150B is provided in place of the head 150 and in that the head driver 190B is provided in place of the head driver 190. Hereinafter, in the ink-jet recording apparatus 110B, only parts different from those of the ink-jet recording apparatus 110 are described.

The head driver 190B includes a first circuit board 200B and a second circuit board 202B.

The first circuit board 200B includes the CPU 206 and the plural D/A converters 208. Each of the plural of D/A converters 208 is connected to the CPU 206.

The second circuit board 202B includes the plural differential amplifier circuits 210 which are provided so as to correspond to the plural D/A converters 208 respectively, the plural amplifiers 212 are provided so as to the respective differential amplifier circuits 210, the CPU 214, the DC-DC converter 216, the ROM 228, the RAM 230 and an AND gate 240.

The head driver 190B includes the plural connectors 204. Each of the plural connectors 204 mechanically connects the first circuit board 200B and the second circuit board 202B such that an analog signal which is output from each of the corresponding D/A converters 208 is input to an input terminal of each of the corresponding differential amplifier circuits 210.

The CPU 214 is connected to an output terminal of the AND gate 240. The AND gate 240 has plural input terminals which correspond to the plural connectors 204 respectively. The plural input terminals are connected to the CPU 206 via the corresponding connectors 204, respectively.

In the ink-jet recording apparatus 110B according to the second exemplary embodiment, the CPU 206 generates a predetermined signal for each of the plural connectors 204, and outputs the generated predetermined signal to the AND gate 240 via each of the corresponding connectors 204.

The head 150B includes the plural actuators 158 and the plural switches 226 which correspond to the respective actuators 158. Each of the plural switches 226 is connected to an output terminal of each of the corresponding amplifiers 212.

In the ink-jet recording apparatus 110B configured as described above, when predetermined signals are input to all of the input terminals of the AND gate 240, the predetermined signals are output to the CPU 214, while, when the predetermined signal is not input to any one of the input terminals, the predetermined signal is not output to the CPU 214.

As described above in detail, the ink-jet recording apparatus 110B according to the second exemplary embodiment has the plural D/A converters 208, connectors 204, and operational amplifiers 212 so as to correspond to the plural capacitive loads (actuators 158). The transmitter (CPU 206) transmits the predetermined signals to the second circuit board 202B via the plural connectors 204, respectively. When at least one of the predetermined signals which are transmitted by the transmitter via the plural connectors 204 respectively is not received, the controller (CPU 214), in the second circuit board 202B, performs control so as to inhibit a voltage of an analog signal from being applied to a capacitive load which corresponds to the connector 204 via which the predetermined signal is supposed to be passed. This can prevent damage of the switching element (switch 226) attributed to poor connection of the connector 224 in the drive circuit corresponding to the plural capacitive loads.

Moreover, according to the ink-jet recording apparatus 110B according to the second exemplary embodiment, the plural D/A converters 208 differentially output the analog signals, respectively. The ink-jet recording apparatus 110B further includes the plural differential amplifier circuits 210. The plural differential amplifier circuits 210 correspond to the plural operational amplifiers 212 and are provided in the preceding stages of the corresponding operational amplifiers 212 respectively in the second circuit board 202B. The analog signals which are differentially output from the D/A converters 208 which correspond to the operational amplifiers 212 respectively are input to the differential amplifier circuits 210, and the differential amplifier circuits 210 differentially amplify the analog signals. This can reduce noise superimposed on the analog signals in portions of the connectors 204 in the second circuit board 202B.

Furthermore, according to the ink-jet recording apparatus 110B of the second exemplary embodiment, in the second circuit board 202B, when at least one of the predetermined signals which are transmitted by the transmitter via the plural connections 204 respectively is not received, the controller performs the control so as to inhibit the differential amplifier circuit 210 from being actuated. Each of the differential amplifier circuit 210 is provided in a preceding stage of each the operational amplifiers 212 which corresponds to a connector 204 via which a predetermined signal is supposed to be passed. In this manner, the controller performs the control so as to inhibit the voltage of the analog signal from being applied to a capacitive load which corresponds to the connector 204. This can prevent the damage of the switching element attributed to poor connection of connectors 204 in the drive circuit which correspond to the plural capacitive loads at low cost and with certainty.

While the invention has been described using the foregoing exemplary embodiments, the technical scope of the invention is not limited to the scope described in the foregoing exemplary embodiments. Various modifications or improvements may be added to the foregoing exemplary embodiments in the scope not departing from the gist of the invention, and embodiments with the modifications and improvements added thereto are included in the technical scope of the invention.

The foregoing exemplary embodiments do not limit the invention described in the claims, and not all the combinations of characteristics described in the foregoing exemplary embodiments are required for means for solving the problems. The inventions in various stages are included in the foregoing exemplary embodiments, such that various inventions may be extracted by combination suited to a situation in plural disclosed configuration requirements. Even if several configuration requirements are deleted from all the configuration requirements shown in the foregoing exemplary embodiments, a configuration resulting from deleting these several configuration requirements may be extracted as the invention as long as an effect is obtained.

For example, while in the second exemplary embodiment, when the CPU 214 does not receive the predetermined signal, the CPU 214 performs the control so as to inhibit the voltage of the analog signal from being applied to all the actuators 158 via the corresponding switches 226, the invention is not limited to this. The control may be performed so as to inhibit the voltage of the analog signal from being applied to the corresponding actuator 158 via the switch 226 which corresponds to the connector 204 via which the predetermined signal is not output. For example, the CPU 206 may constantly output the respective predetermined signals which are generated for the plural connectors 204 to the CPU 214 via the corresponding connectors 204, the predetermined signal can be detected in the CPU 214, and the CPU 214 can perform the control so as to inhibit the voltage of the analog signal from being applied to the corresponding actuator 158 via the switch 226 which corresponds to the connector 204 via which the predetermined signal is not output.

Moreover, the configuration of the ink-jet recording apparatus 110 described in the first exemplary embodiment (see FIGS. 1 to 8), and the configuration of the ink-jet recording apparatus 110B described in the second exemplary embodiment (see FIG. 11) are illustrative only, and thus, modifications suited to a situation may be made within the scope not departing from the gist of the invention.

Moreover, the flow of the processing of the program described in the foregoing exemplary embodiments (see FIG. 10) is also illustrative, and an unnecessary step may be deleted, a new step may be added, or the processing order may be exchanged within the scope departing from the gist of the invention.

As described above, according to a first aspect of the invention, there is provided a signal processing apparatus including a first circuit board including a digital/analog converter which converts, to an analog signal, a digital signal as a reference of a voltage to be applied to a capacitive load, and outputs the analog signal; a second circuit board including an operational amplifier connected to the capacitive load at an output terminal thereof via a switching element, that amplifies the voltage of the analog signal and outputs the analog signal; a connector that mechanically connects the first circuit board and the second circuit board such that the analog signal output from the digital/analog converter is input to an input terminal of the operational amplifier; a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

According to the signal processing apparatus according to the first aspect, the transmitter transmits the predetermined signal from the first circuit board having the digital/analog converter which converts, to the analog signal, the digital signal as the reference of the voltage to be applied to the capacitive load and outputs the analog signal, to the second circuit board having the operational amplifier which is connected to the capacitive load at the output terminal thereof via the switching element and amplifies the voltage of the analog signal to output, via the connector which mechanically connects the first circuit board and the second circuit board such that the analog signal which is output from the digital/analog converter is input to the input terminal of the operational amplifier.

When the predetermined signal is not received in the second circuit board, the controller prevents the voltage of the analog signal from being applied to the capacitive load via the switching element.

In this manner, when the predetermined signal which is supposed to be received via the connector is not received, it is considered that poor connection is caused in the connector, and the control is performed so as to prevent the voltage of the analog signal from being applied to the capacitive load via the switching element. This can prevent damage of the switching element attributed to the poor connection of the connector.

According to a second aspect of the invention, in the signal processing apparatus according to the first aspect, the digital/analog converter differentially may output the analog signal, and the signal processing apparatus may further include a differential amplifier circuit that is provided at a preceding stage of the operational amplifier in the second circuit board, to which is input the analog signal differentially output from the digital/analog converter, and which differentially amplifies the analog signal. This can reduce noise superimposed on the analog signal in a portion of the connector, in the second circuit board.

According to a third aspect of the invention, in the signal processing apparatus according to the second aspect, the controller may prevent the differential amplifier circuit from operating, to prevent the voltage of the analog signal from being applied to the capacitive load. This can prevent damage of the switching element attributed to the poor connection of the connector at low cost and with certainty.

According to a fourth aspect of the invention, the signal processing apparatus according to the first aspect may further include a plurality of digital/analog converters, a plurality of connectors and a plurality of operational amplifiers with respect to a plurality of capacitive loads, wherein the transmitter may transmit a plurality of predetermined signals to the second circuit board via the plurality of connectors respectively, and when at least one of the plurality of predetermined signals which are transmitted by the transmitter via the plurality of connectors is not received in the second circuit board, the controller may prevent a voltage of an analog signal from being applied to a capacitive load which corresponds to a connector via which the at least one predetermined signal is supposed to be transmitted. This can prevent damage of the switching element attributed to poor connection of the connector in the drive circuit corresponding to the plural capacitive loads.

According to a fifth aspect of the invention, in the signal processing apparatus according to the fourth aspect, the plurality of digital/analog converters respectively may differentially output corresponding analog signals, and the signal processing apparatus further may include a plurality of differential amplifier circuits which correspond to the plurality of operational amplifiers, respectively, and which are provided at preceding stages of the corresponding plurality of operational amplifiers in the second circuit board, to which are input the analog signals differentially output from the digital/analog converters, and which differentially amplify the analog signals. This can reduce noise superimposed on the analog signals in portions of the connectors, in the second circuit board.

According to a sixth aspect of the invention, in the signal processing apparatus according to the fifth aspect, when at least one of the plurality of predetermined signals which are transmitted by the transmitter via the plurality of connectors, respectively, is not received in the second circuit board, the controller may prevent a differential amplifier circuit, which is provided at a preceding stage of an operational amplifier which corresponds to a connector via which the at least one of the plurality of predetermined signals is supposed to be transmitted, from operating, to prevent a voltage of an analog signal from being applied to a capacitive load which corresponds to the connector. This can prevent the damage of the switching element attributed to poor connection of the connector in the drive circuit corresponding to the plural capacitive loads at low cost and with certainty.

Moreover, according to a seventh aspect of the invention, there is provided a droplet ejection apparatus including: a droplet ejection head including nozzles, the nozzles each ejecting a droplet by a piezoelectric element being driven; a head controller that controls the droplet ejection head so as to eject the droplets from the nozzles on a recording medium based on image information; and a signal processing apparatus including: a first circuit board including a digital/analog converter which converts, to an analog signal, a digital signal as a reference of a voltage to be applied to a capacitive load and outputs the analog signal, the capacitive load being the piezoelectric element; a second circuit board including an operational amplifier connected to the capacitive load at an output terminal thereof via a switching element, that amplifies the voltage of the analog signal and outputs the analog signal; a connector that mechanically connects the first circuit board and the second circuit board such that the analog signal output from the digital/analog converter is input to an input terminal of the operational amplifier; a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

According to the droplet ejection apparatus according to the seventh aspect, the droplet is ejected from each of the nozzles of the droplet ejection head by the piezoelectric element being driven. Moreover, the head controller controls the droplet ejection head so as to eject the droplet from each of the nozzles on a recording medium based on image information.

The transmitter of the signal processing apparatus transmits the predetermined signal from the first circuit board having the digital/analog converter which converts, to the analog signal, the digital signal as the reference of the voltage to be applied to the piezoelectric element and outputs the analog signal, to the second circuit board having the operational amplifier which is connected to the piezoelectric element at the output terminal thereof via the switching element and amplifies the voltage of the analog signal to output, via the connector which mechanically connects the first circuit board and the second circuit board such that the analog signal which is output from the digital/analog converter is input to the input terminal of the operational amplifier.

When the predetermined signal is not received in the second circuit board, the controller of the signal processing apparatus prevents the voltage of the analog signal from being applied to the piezoelectric element via the switching element.

The droplet ejection apparatus according to the seventh aspect has the signal processing apparatus according to the first aspect. Thus, as in the signal processing apparatus, the damage of the switching element attributed to the poor connection of the connector can be prevented.

Moreover, the droplet ejection apparatus according to the seventh aspect can have the signal processing apparatus according to the second to sixth aspects. This brings about the similar operation to that of the signal processing apparatus according to the second to sixth aspects and thus, similar effects are exerted.

According to an eighth aspect of the invention, there is provided a signal processing method including: transmitting a predetermined signal from a first circuit board including a digital/analog converter which converts, to an analog signal, a digital signal as a reference of a voltage to be applied to a capacitive load, and outputs the analog signal, to a second circuit board including an operational amplifier connected to the capacitive load at an output terminal thereof via a switching element, that amplifies the voltage of the analog signal and outputs the analog signal, via a connector which mechanically connects the first circuit board and the second circuit board such that the analog signal output from the digital/analog converter is input to an input terminal of the operational amplifier; and controlling to prevent the voltage of the analog signal from being applied to the capacitive load via the switching element when the predetermined signal is not received in the second circuit board.

Accordingly, the signal processing method according to the eighth aspect brings about similar operation to that of the first aspect of the invention. Thus, similar to the invention according to the first aspect, the damage of the switching element attributed to the poor connection of the connector may be prevented.

As described above, according to the invention, the effect of preventing the damage of the switching element attributed to the poor connection of the connector may be attained.

Embodiments of the present invention are described above, but the present invention is not limited to the embodiments as will be clear to those skilled in the art.

What is claimed is:

1. A signal processing apparatus comprising:

a first circuit board comprising a digital/analog converter which converts, to an analog signal, a digital signal as a reference of a voltage to be applied to a capacitive load, and outputs the analog signal;

a second circuit board comprising an operational amplifier connected to the capacitive load at an output terminal thereof via a switching element, that amplifies the voltage of the analog signal and outputs the analog signal;

a connector that mechanically connects the first circuit board and the second circuit board such that the analog signal output from the digital/analog converter is input to an input terminal of the operational amplifier;

a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

2. The signal processing apparatus of claim 1, wherein the digital/analog converter differentially outputs the analog signal, and the signal processing apparatus further comprises a differential amplifier circuit that is provided at a preceding stage of the operational amplifier in the second circuit board, to which is input the analog signal differentially output from the digital/analog converter, and which differentially amplifies the analog signal.

3. The signal processing apparatus of claim 2, wherein the controller prevents the differential amplifier circuit from operating, to prevent the voltage of the analog signal from being applied to the capacitive load.

4. The signal processing apparatus of claim 1, further comprising a plurality of digital/analog converters, a plurality of connectors and a plurality of operational amplifiers with respect to a plurality of capacitive loads, wherein the transmitter transmits a plurality of predetermined signals to the second circuit board via the plurality of connectors respectively, and when at least one of the plurality of predetermined signals which are transmitted by the transmitter via the plurality of connectors is not received in the second circuit board, the controller prevents a voltage of an analog signal from being applied to a capacitive load which corresponds to a connector via which the at least one predetermined signal is supposed to be transmitted.

5. The signal processing apparatus of claim 4, wherein the plurality of digital/analog converters respectively differentially output corresponding analog signals, and the signal processing apparatus further comprises a plurality of differential amplifier circuits which correspond to the plurality of operational amplifiers, respectively, and which are provided at preceding stages of the corresponding plurality of operational amplifiers in the second circuit board, to which are input the analog signals differentially output from the digital/analog converters, and which differentially amplify the analog signals.

6. The signal processing apparatus of claim 5, wherein, when at least one of the plurality of predetermined signals which are transmitted by the transmitter via the plurality of connectors, respectively, is not received in the second circuit board, the controller prevents a differential amplifier circuit, which is provided at a preceding stage of an operational amplifier which corresponds to a connector via which the at least one of the plurality of predetermined signals is supposed to be transmitted, from operating, to prevent a voltage of an analog signal from being applied to a capacitive load which corresponds to the connector.

7. A droplet ejection apparatus comprising:

a droplet ejection head comprising nozzles, the nozzles each ejecting a droplet by a piezoelectric element being driven;

a head controller that controls the droplet ejection head so as to eject the droplets from the nozzles on a recording medium based on image information; and a signal processing apparatus comprising:

a first circuit board comprising a digital/analog converter which converts, to an analog signal, a digital signal as a reference of a voltage to be applied to a capacitive load and outputs the analog signal, the capacitive load being the piezoelectric element;

a second circuit board comprising an operational amplifier connected to the capacitive load at an output terminal thereof via a switching element, that amplifies the voltage of the analog signal and outputs the analog signal;

a connector that mechanically connects the first circuit board and the second circuit board such that the analog signal output from the digital/analog converter is input to an input terminal of the operational amplifier;

a transmitter provided in the first circuit board that transmits a predetermined signal to the second circuit board via the connector; and a controller that, when the predetermined signal is not received in the second circuit board, prevents the voltage of the analog signal from being applied to the capacitive load via the switching element.

8. The droplet ejection apparatus of claim 7, wherein the digital/analog converter differentially outputs the analog signal, and the signal processing apparatus further comprises a differential amplifier circuit that is provided at a preceding stage of the operational amplifier in the second circuit board, to which is input the analog signal differentially output from the digital/analog converter, and which differentially amplifies the analog signal.

9. The droplet ejection apparatus of claim 8, wherein the controller prevents the differential amplifier circuit from operating to prevent the voltage of the analog signal from being applied to the capacitive load.

10. The droplet ejection apparatus of claim 7, wherein the signal processing apparatus further comprises a plurality of digital/analog converters, a plurality of connectors and a plurality of operational amplifiers with respect to a plurality of capacitive loads, the transmitter transmits a plurality of predetermined signals to the second circuit board via the plurality of connectors, respectively, and when at least one of the plurality of predetermined signals which are transmitted by the transmitter via the plurality of connectors, respectively, is not received in the second circuit board, the controller prevents a voltage of an analog signal from being applied to a capacitive load which corresponds to a connector via which the at least one of the plurality of predetermined signals is supposed to be transmitted.

11. The droplet ejection apparatus of claim 10, wherein the plurality of digital/analog converters respectively differentially output corresponding analog signals, and the signal processing apparatus further comprises a plurality of differential amplifier circuits which correspond to the plurality of operational amplifiers and which are provided at preceding stages of the corresponding plurality of operational amplifiers in the second circuit board, to which are input the analog signals differentially output from the digital/analog converters, and which differentially amplify the analog signals.

12. The droplet ejection apparatus of claim 11, wherein when at least one of the plurality of predetermined signals which are transmitted by the transmitter via the plurality of connectors, respectively, is not received in the second circuit board, the controller prevents a differential amplifier circuit, which is provided at a preceding stage of an operational amplifier which corresponds to a connector via which the at least one of the plurality of predetermined signals is supposed to be transmitted, from operating, to prevent a voltage of an analog signal from being applied to a capacitive load which corresponds to the connector.

13. A signal processing method comprising:

transmitting a predetermined signal from a first circuit board comprising a digital/analog converter which converts, to an analog signal, a digital signal as a reference of a voltage to be applied to a capacitive load, and outputs the analog signal, to a second circuit board comprising an operational amplifier connected to the capacitive load at an output terminal thereof via a switching element, that amplifies the voltage of the analog signal and outputs the analog signal, via a connector which mechanically connects the first circuit board and the second circuit board such that the analog signal output from the digital/analog converter is input to an input terminal of the operational amplifier; and controlling to prevent the voltage of the analog signal from being applied to the capacitive load via the switching element when the predetermined signal is not received in the second circuit board.

* * * * *